US006364821B1

(12) United States Patent
Mariotti et al.

(10) Patent No.: US 6,364,821 B1
(45) Date of Patent: Apr. 2, 2002

(54) LONGITUDINAL FOLDING DEVICE IN A FOLDER OF A WEB-FED PRINTING MACHINE, AND METHOD OF ADJUSTMENT

(75) Inventors: Jean Mariotti, Monchy-St-Eloi; Thierry Thevenin, Margny les Compiegne, both of (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/312,573

(22) Filed: May 14, 1999

(30) Foreign Application Priority Data

May 14, 1998 (DE) ..... 198 21 603

(51) Int. Cl.[7] ..... B35B 1/12; B05D 5/10

(52) U.S. Cl. ..... 493/331; 493/162; 493/242; 493/264; 493/428; 493/477

(58) Field of Search ..... 493/162, 164, 493/167, 174, 183, 242, 248, 269, 270, 276, 279, 308, 428, 449, 477, 478, 479

(56) References Cited

U.S. PATENT DOCUMENTS

| | | | | |
|---|---|---|---|---|
| 3,442,504 A | * | 5/1969 | Halley | 493/442 |
| 4,666,423 A | * | 5/1987 | Herrington | 493/248 |
| 5,048,809 A | * | 9/1991 | Tebbe et al. | 270/45 |
| 5,685,528 A | * | 11/1997 | Weis | 270/6 |
| 5,718,661 A | | 2/1998 | Michalik | 493/439 |
| 5,832,825 A | * | 11/1998 | Baldie et al. | 101/219 |
| 6,024,684 A | * | 2/2000 | Maylander et al. | 270/41 |

FOREIGN PATENT DOCUMENTS

| | | |
|---|---|---|
| DE | 36 24 990 C2 | 2/1988 |
| DE | 296 15 146 U1 | 1/1997 |
| DE | 195 48 814 A1 | 7/1997 |
| DE | 196 02 248 A1 | 7/1997 |
| EP | 0 254 095 A2 | 1/1988 |
| EP | 0 781 723 A2 | 7/1997 |
| JP | 7-29725 | 3/1988 |
| JP | 7-18682 | 3/1994 |

* cited by examiner

*Primary Examiner*—Peter Vo
*Assistant Examiner*—Hemant M. Desai
(74) *Attorney, Agent, or Firm*—Herbert L. Lerner; Laurence A. Greenberg; Werner H. Stemer

(57) ABSTRACT

There is provided, in a folder for web-fed printing machines for processing webs of material with longitudinal adhesive bonding, a longitudinal folding device including a displaceable folder former movable relative to a cylinder part of the folder, and a frame carrying former outlet rollers and spindles whereon the former outlet rollers are mounted, the frame being displaceable with the longitudinal folding device; further provided is a method of adjusting the longitudinal adjusting device.

16 Claims, 6 Drawing Sheets

LONGITUDINAL FOLDING DEVICE IN A FOLDER OF A WEB-FED PRINTING MACHINE, AND METHOD OF ADJUSTMENT

BACKGROUND OF THE INVENTION

Field of the Invention

The invention relates to a longitudinal folding device in a folder of a web-fed printing machine, printed webs of material entering into the folder via the longitudinal folding device subsequent to a drying and cooling operation. The invention also relates to a method of adjusting the longitudinal folding device.

In the prior art, the published Japanese Patent Document JP Hei 7-18682 has disclosed a device for regulating the first longitudinal fold on a folder former. In order to achieve a more precise and pronounced formation of the first longitudinal fold on webs of material with low and high grammage or weight, the folder former is provided with a nose that is arranged so as to be adjustable. The former nose, which is located beneath a material web outlet from the former plate, is remotely-controllably pivotable by an adjusting cylinder arranged behind the former plate.

The published Japanese Patent Document JP Hei 7-29725 relates to a device for adjusting the former of a folder. A drive is arranged on a main frame carrying an inclined former plate and, via an elongated shaft, drives an auxiliary frame in which a former infeed roller is mounted. If there is a change in the web format that is processed in the first longitudinal folding arrangement and in the downline folder, it is then possible simultaneously to adjust the former infeed roller mounted in the auxiliary frame, and the former plate mounted in the main frame. By this simultaneously occurring adjustment of the former infeed roller and the former plate, the incoming material web is displaced, in the travel plane thereof, axially to the former infeed rollers, whereas the former infeed rollers are connected in a stationary manner to the folder cylinder part and are, accordingly, not displaceable for adjusting purposes.

The technical problem solved by the invention is that, in the course of successive printing jobs or orders, weights and formats or sizes of the papers which are to be processed may vary, which has heretofore resulted in a considerable amount of time being wasted, due to required changeover or conversion work, until production resumes. In the case of a change in the width of the material web that is to be processed, it is necessary, virtually without exception, for the former to be adjusted relative to the folder cylinder part. If the outlet or runout rollers, which are usually laid out or designed, in the length thereof, for the maximum processable web format, are inclined to one another, it would be desirable to maintain the once set angle of inclination, as is similarly the case with other already pre-set parameters which are not to be influenced by the web format.

If areas of adhesive for subsequently performed adhesive bonding on copies cut from the web of material are applied to individual web lengths which are cut longitudinally in the turner-bar or angle-bar superstructure, and then guided together over various folder formers, it is necessary for the region of the web of material to which the adhesive is applied to run into the folder cylinder part via an annular recess formed in the outlet rollers of the first longitudinal folding arrangement. If other web formats with exactly like areas of adhesive are processed, care should be taken that the areas of adhesive always run over that region of the outlet rollers in which the annular recesses are located.

SUMMARY OF THE INVENTION

It is accordingly an object of the invention to provide a longitudinal folding device in a folder of a web-fed printing device wherein, during a change in the format of a web of material that is to be processed therein, protracted adjustment work on the infeed rollers is minimized so as to be able to resume production more quickly after the web format, and possibly the paper sheet format, have been changed.

With the foregoing and other objects in view, there is provided, in accordance with the invention, in a folder for web-fed printing machines for processing webs of material with longitudinal adhesive bonding, a longitudinal folding device including a displaceable folder former movable relative to a cylinder part of the folder, comprising a frame carrying former outlet rollers and spindles whereon the former outlet rollers are mounted, the frame being displaceable with the longitudinal folding device.

In accordance with another feature of the invention, the spindles are movable relative to the former outlet rollers.

In accordance with a further feature of the invention, the spindles are movable axially relative to the former outlet rollers.

In accordance with an added feature of the invention, the former outlet rollers are disposed, through the intermediary of a roller support, on framework walls of the folder.

In accordance with an additional feature of the invention, the spindles are adjustable relative to one another on the frame.

In accordance with yet another feature of the invention, the longitudinal folding device includes an adjusting device for adjusting the spindles of the former outlet rollers at a frame-side end thereof.

In accordance with yet a further feature of the invention, the spindles of the former outlet rollers are adjustable in a horizontal plane on the frame.

In accordance with yet an added feature of the invention, the spindles of the former outlet rollers are adjustable in a vertical plane on the frame.

In accordance with yet an additional feature of the invention, the former outlet rollers are formed approximately centrally with an annular recess.

In accordance with still another feature of the invention, roller sections of the former outlet rollers have a coating formed thereon.

In accordance with still a further feature of the invention, the longitudinal folding device includes crossmembers whereon the frame is displaceably mounted.

In accordance with still an added feature of the invention, the frame has rolling elements supported on crossmembers.

In accordance with still an additional feature of the invention, the frame has slide guides through which the crossmembers extend.

In accordance with another aspect of the invention, there is provided a folder for web-fed printing machines having a longitudinal folding device for processing webs of material with longitudinal adhesive bonding, including a displaceable former movable relative to a cylinder part of the folder, and comprising a frame carrying former outlet rollers, and spindles whereon the former outlet rollers are mounted, the frame being displaceable with the longitudinal folding device.

In accordance with a concomitant aspect of the invention, there is provided a method of adjusting a first longitudinal folding device for processing material webs with longitudinal adhesive bonding in a folder of a web-fed printing machine, the first longitudinal folding device being movable relative to the folder, which comprises the steps of fixing the position of the former outlet rollers relative to a cylinder part of the folder, displacing a frame whereon spindles of the former outlet rollers are displaceably carried, thereby maintaining the distance of the web of material relative to the surfaces of the former outlet rollers, aligning an annular recess, centrally formed in the former outlet rollers, with an axis of the folder, for the purpose of applying the adhesive with regard to any width of material web to be processed.

An advantage of the device according to the invention is that a set angle of the former outlet rollers relative to one another does not need to be adjusted if it is necessary to change over from maximum web-width processing to minimum web-width processing or any stage in between. This angle is constant irrespective of the web widths or the printing-material grammage being processed. Furthermore, the distance between the web, or the lengths of the web of material, and the outside of the former outlet rollers remains constant during an adjustment, because the outlet rollers move parallel to the mutually inclined spindles. Finally, the selected construction ensures t hat the application of adhesive, which is usually located centrally with respect to the web, is always located parallel to the axis of the folder, and the annular recesses are always located in the center of the folder.

In further constructions based upon the concept of the invention, the spindles can be moved relative to the former outlet rollers. Because the spindles move relative to the former rollers and are connected to the first longitudinal folding device, during changeovers, they automatically move together with the frame that is connected to the first longitudinal folding device. The former outlet rollers themselves may be connected to the cylinder part of the folder and, accordingly, are in a stationary position. The spindles, which can be adjusted relative to the former outlet rollers, may be provided in a frame so that they can be adjusted or set relative to one another. For this purpose, on the web side and on the drive side of the frame, it is possible to provide an adjusting device by the aid of which the spindles of the former outlet rollers can be adjusted or set precisely both in the horizontal direction and in the vertical direction for the purpose of pre-setting the roller position. When changing over from the processing of one web format to another, in contrast, actuation of the adjusting device is not necessary; if, on the other hand, another printing-material grammage or weight is processed, then an adjustment may well be necessary.

The former outlet rollers are formed, approximately centrally, with an annular recess, through which the adhesive material passes without coming into contact with the surfaces of the roller. The surfaces of the former outlet rollers may be provided with a coating which prevents ink from being deposited on the lateral surfaces of the rollers.

The capacity for movement of the first longitudinal folding device and of the frame relative to the former outlet rollers can be realized in that the frame, together with the adjustable spindles mounted thereon, is supported on crossmembers and is displaceable thereon. For this purpose, it is possible to provide slide guides beneath the frame, for example at corner locations of the latter, and it is also possible to provide, on the frame, rolling elements which roll on the crossmembers which extend parallel to the displacement path of the frame.

The device according to the invention may be disposed on a first longitudinal folding device, above a cylinder part of a folder. Depending upon variability, it is possible for a plurality of the first longitudinal folding devices according to the invention, having displaceable spindles for the former outlet rollers, to be arranged upline of a folder cylinder part, notwithstanding whether the spindles are in parallel, side-by-side or in series.

Also disclosed in addition to the longitudinal folding device is a method of adjusting a first longitudinal folding device on the folder.

Other features which are considered as characteristic for the invention are set forth in the appended claims.

Although the invention is illustrated and described herein as embodied in a longitudinal folding device in a folder of a web-fed printing machine and method of adjustment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
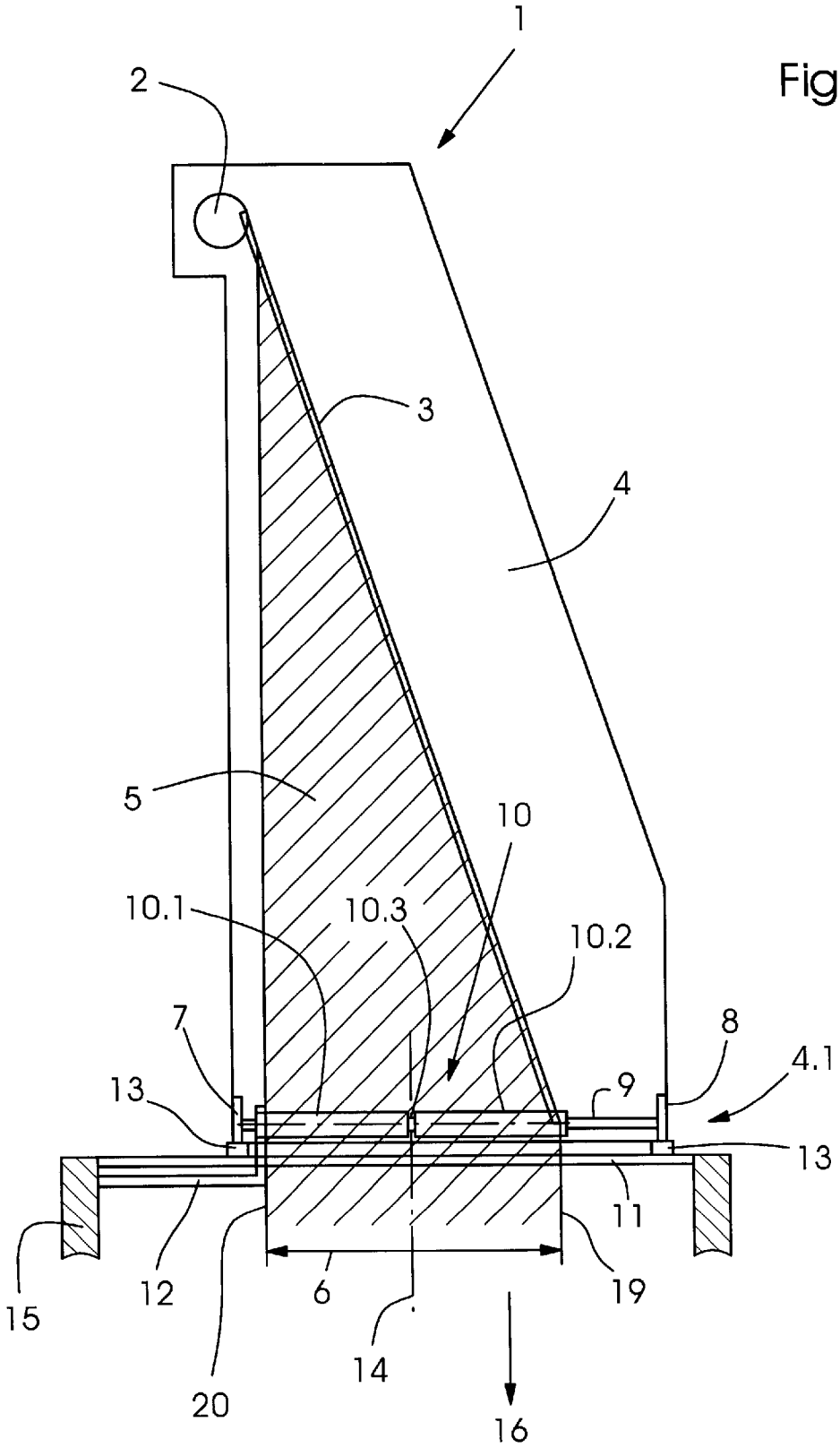
FIG. 1 is a side elevational view of a first longitudinal folding device according to the invention for introducing a web of material having a maximum processable web width into a folder.

Referring now to the drawings and, first, particularly to FIG. 1 thereof, there is shown therein a first longitudinal folding device 1 according to the invention for guiding a web of material having a maximum processable web width.

The first longitudinal folding device 1 that is illustrated diagrammatically in FIG. 1 includes an upper infeed roller 2 over which a material web runs onto a former plate 3. The former plate 3 is disposed in an adjustably movable former frame 4 which, in the view of FIG. 1, is located in a first position 4.1.

Fastened at the bottom end of the former frame 4 is a frame that, for its part, carries spindles 9 which are only diagrammatically illustrated in FIG. 1. According to the invention, the frame 8 which also carries the former outlet rollers 10, is fastened on the adjustable former frame 4 and is movable together therewith. Due to the fact that the spindles 9 are carried by the frame 8 at the former end 4, the spindles 9 are movable relative to the former outlet rollers 10. The former outlet rollers 10 have an approximately central annular recess 10.3 therebetween, alongside of which there are located a first roller section 10.1 and a second roller section 10.2. The former rollers 10 are mounted so as to be stationary on a respective framework wall 15 of a bracing member by a support 12. The bracing-member framework wall 15 represents the framework walls of a folder that is disposed immediately downline of the first longitudinal folding device 1.

It should also be emphasized that the spindles 9, upon which the former outlet rollers 10 are mounted, can be displaced relative to the latter by a movement of the frame 8, which changes the position of the material web 5 relative to the rollers 10.

In the exemplary embodiment shown in FIG. 1, the diagrammatically illustrated roller support 12 is fastened stationarily to one of the bracing-member framework walls 15. The illustrated material web 5 has a maximum web width 6 and is transported, approximately centrally to the axis 14 of the folder, in the direction of a continuing web path 16. The continuing web path 16 may constitute the direct infeed into a folder arranged downtime of the first longitudinal folding device 1 according to the invention, in which case the framework walls 15 constitute the side walls of the folder.

Figure 2:
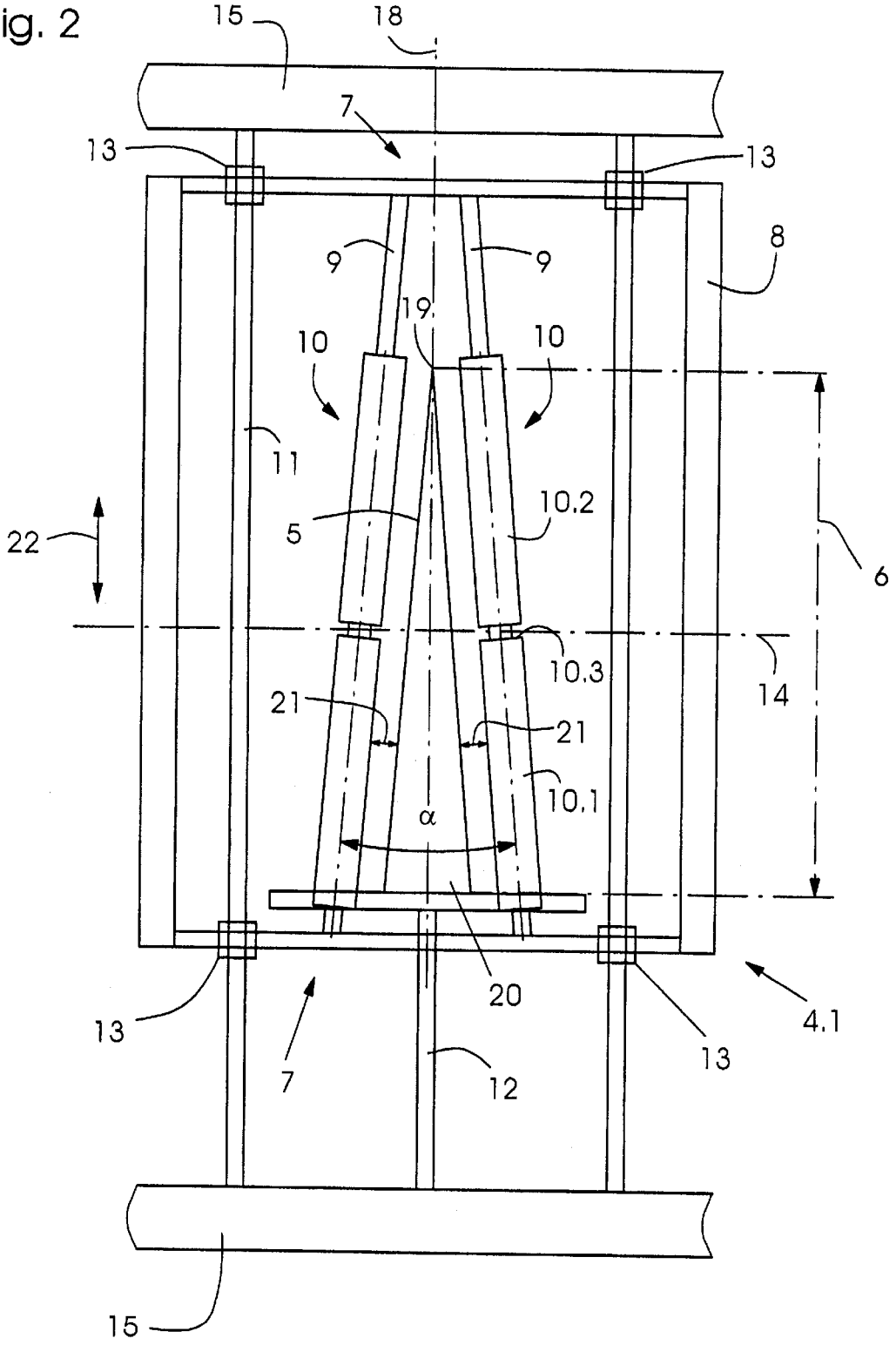
FIG. 2 is an enlarged plan view of FIG. 1 rotated through 90° counterclockwise, and showing the position of the frame that moves the former outlet rollers.

As is also apparent from FIG. 1, the material web 5, after having passed through the first longitudinal folding device 1, is provided with a first longitudinal fold 19 and has an open end 20 located opposite thereto (note also FIG. 2).

FIG. 2 is a plan view of the frame in a position thereof corresponding to that of FIG. 1, wherein the frame moves the former outlet rollers.

It is apparent from FIG. 2 that the frame 8 is supported on guide rails 11. It is possible for the frame 8 to be moved on the guide rails 11, for example, by slide guides 13 which extend from the framework wall 15 to the framework wall 15 and from the bracing member 15 to the bracing member 15, respectively. The frame 8 mounted on the displaceable former frame 4 of the first longitudinal folding device 1 is displaceable in the directions represented by the double-headed arrow 22. On the frame 8, the spindles 9 are received in spindle bearings 7 (note FIGS. 5 and 6). In the illustration of FIG. 2, the spindles 9 are shown positioned at an angle $\alpha$ with respect to one another; the former outlet rollers 10 are located in the axial position shown in FIG. 1. For an identical width of the material web 3, the angle $\alpha$ is constant. In the arrangement of the former outlet rollers 10 illustrated in FIG. 2, a material web 5 of maximum web width 6 is folded longitudinally. The folding spine is represented at 19 and the open side located opposite thereto is identified by reference numeral 20.

In the plan view according to FIG. 2, it is possible to see the roller support 12 by way of which the former outlet rollers 10 are fixed in relation to the framework walls 15. The longitudinally folded paper web 5 is located at a distance 21 from the surfaces of the former outlet rollers 10, which are subdivided centrally, by an annular recess 10.3, into a first roller section 10.1 and a second roller section 10.2. The central annular recess 10.3 is aligned with the axis 14 of the folder and permits an application of adhesive to pass without being transferred to a rotating surface. The first longitudinal fold 19, also referred to herein as a folding spine, is aligned with the axis 18 of the first longitudinal folding device 1. Corresponding to that position of the former frame 4 shown in FIG. 1, the former frame 4, in the position 4.1 thereof according to FIG. 2, is located in an extreme position in which it has been pushed up to the opposite framework wall 15.

Figure 3:
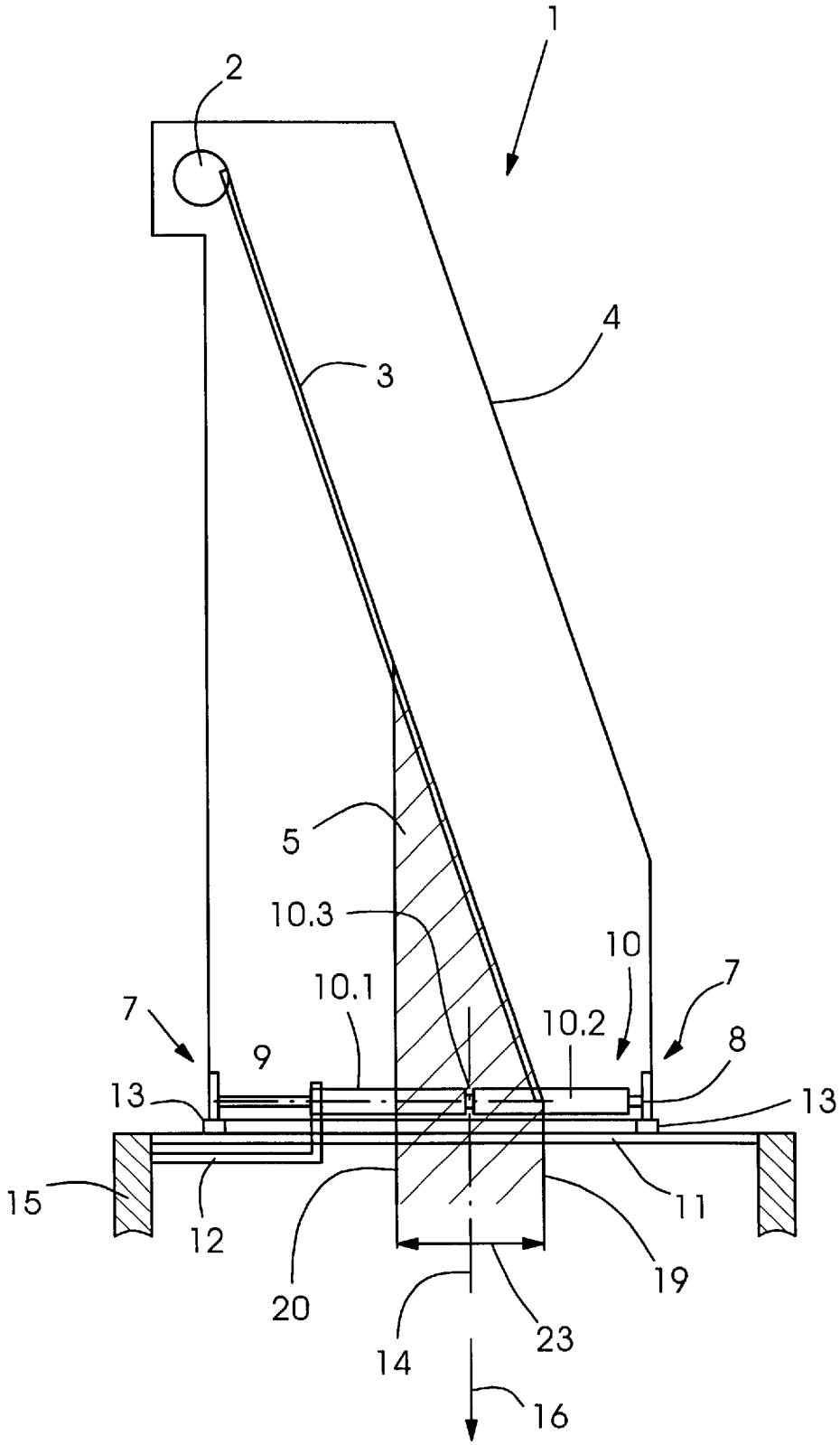
FIG. 3 is a side elevational view of the first longitudinal folding device according to the invention for folding a web of material having a minimum processable web width.

FIG. 3 is a side elevational view of the first longitudinal folding device according to the invention for folding a minimum processable web format.

In this configuration, a minimum processable web format 23 is folded longitudinally, the frame 8 having been moved into a position wherein the former outlet rollers 10 are uniformly disposed more closely together, but the application of adhesive on the material web 5 is again in alignment with the recess 10.3 of the former outlet rollers 10. In this case, the frame 8 has been displaced more closely towards the left-hand bracing member or framework wall 15, as seen in the travel direction 16 of the web. Accordingly, that format width of the material web 5 that is measured by the double-headed arrow 23 extending from the folding spine 19 to the open rear side 20 remains in alignment with the axis 14 of the folder.

Figure 4:
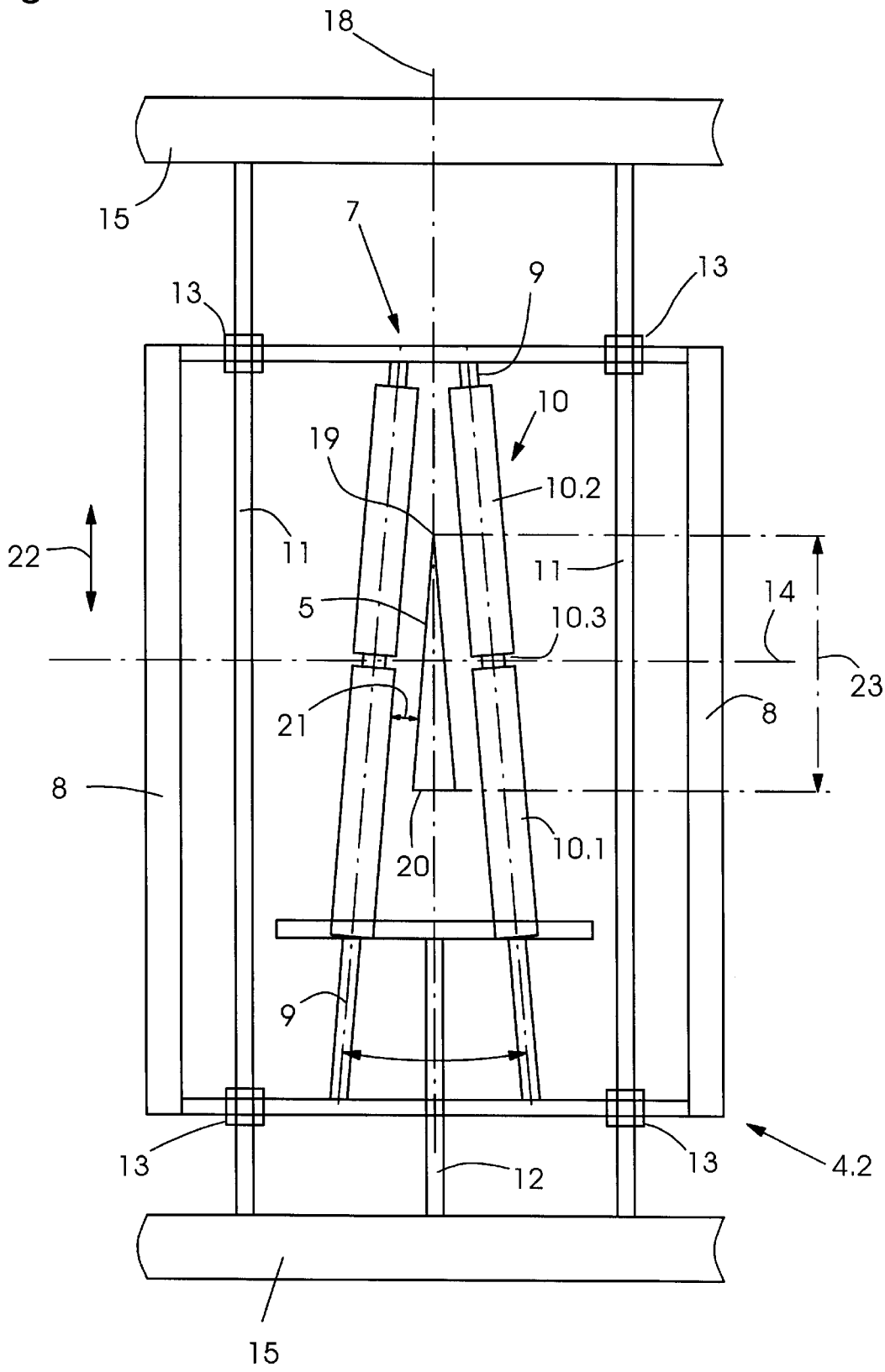
FIG. 4 is a plan view like that of FIG. 2 showing the position of the frame according to FIG. 3.

FIG. 4 is a plan view of the frame 8 in the position thereof during the processing of the minimum web format according to FIG. 3.

In comparison with the position of the frame 8 which is illustrated in FIG. 2, it is apparent from FIG. 4 that, due to the frame 8 being displaced in the direction of the bottom framework wall 15, the former outlet rollers 10 have been positioned closer together, without any need for any changeover operations other than the displacement of the frame 8. The former outlet rollers 10, which are stationarily fastened, are displaced on the respective spindles 9 thereof due to the displacement of the frame 8, so that the former-roller lateral surfaces 10 shift towards one another, because the former rollers 10 are closer together at one end than at the opposite end, on the operative side 19 (fold side) and the open side 20. The adjustment or setting of the former rollers 10 relative to one another is derived from the selected pre-setting of the angle $\alpha$ between the spindles 9 in the frame 8. If the frame 8 moves in the direction of the upper part of the double-headed arrow 22, then, due to the greater distance between the spindles 9, the rollers are moved apart from one another proportionally at the operative-side end thereof and towards one another proportionally at the drive-side end thereof. This is derived from the angle $\alpha$ defined by the spindles 9 relative to one another, a comparison of FIGS. 2 and 4 showing that, respectively, the distance 21 between the material web 5 and the surfaces 10 remains the same, regardless of the width of the respective format 6, 23, and there is no longer any need for any follow-up adjustment.

Figure 5:
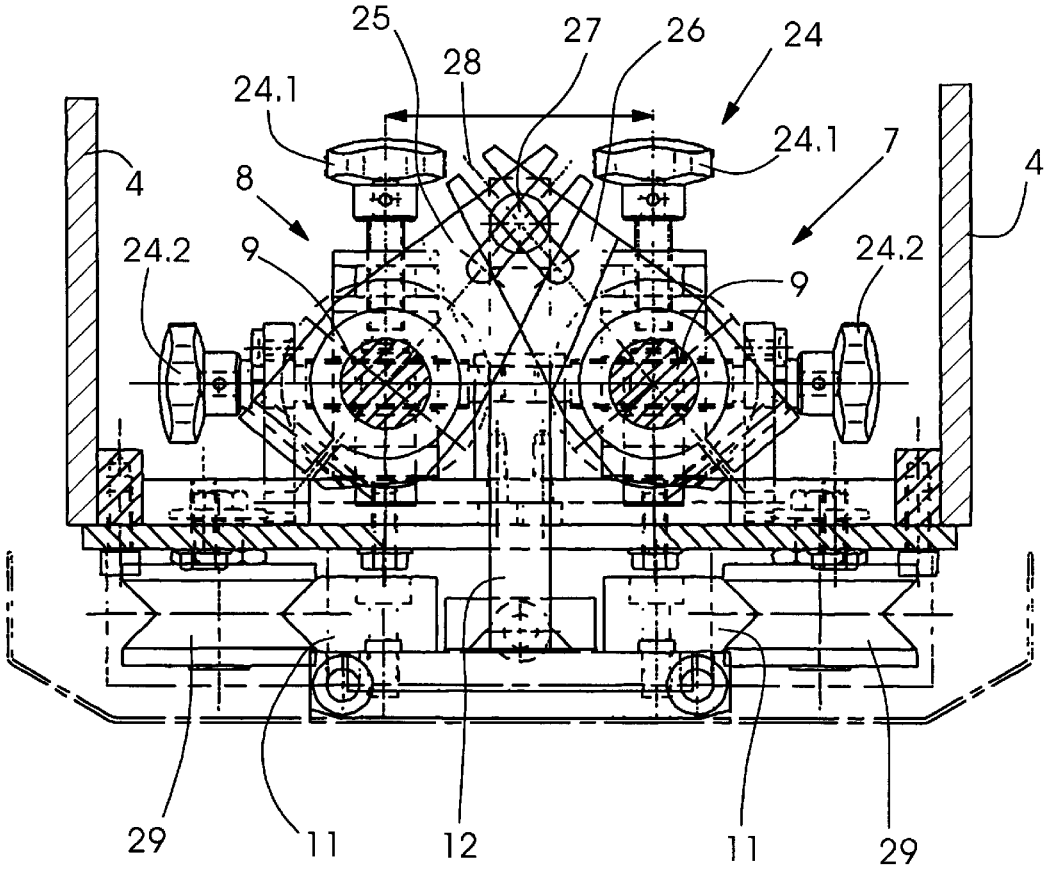
FIG. 5 is a front elevational view of an embodiment of the frame according to the invention.
Figure 6:
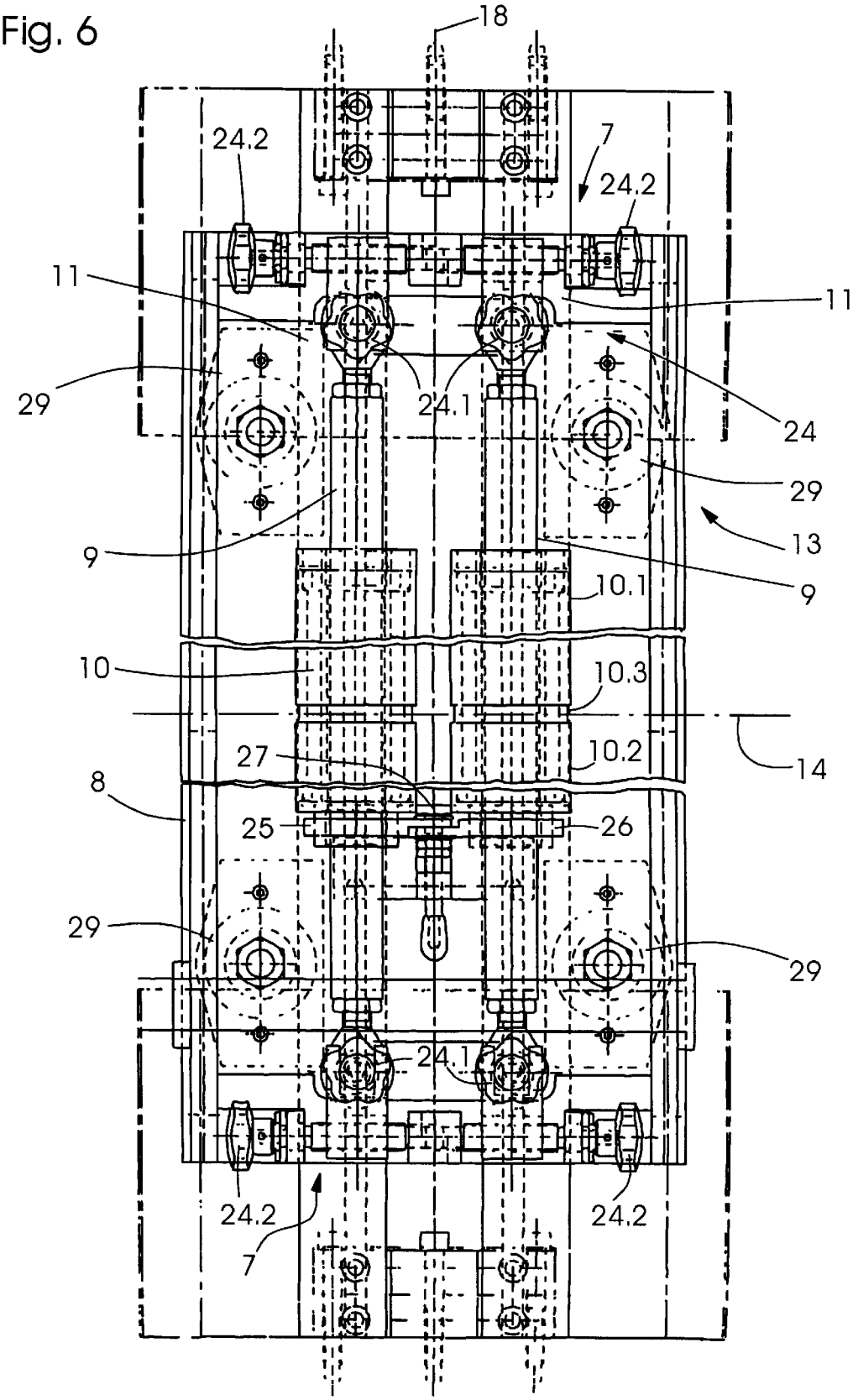
FIG. 6 is a plan view of FIG. 5 showing the frame according to the invention supported on crossmembers on a top part of the folder and disposed so as to be displaceable thereon.

FIGS. 5 and 6 are respective front elevational and plan views of the frame 8. By an adjusting device 24, the respective spindles 9 of the former rollers 10 can be adjusted at the mounting supports 7 thereof in the frame 8. The adjusting device 24 may include both a setting or adjusting element 24.1 for the vertical plane and a setting or adjusting element 24.2 for the horizontal plane. In the illustrated embodiment of the frame 8, the setting or adjusting elements 24.1 and 24.2 are designed as capstanhead or T-screws respectively provided with knurling for manual actuation. By the threaded parts of the knurled screws, the mounting supports 7 of the spindles 9, respectively, are adjustable relative to the frame 8. By an arrangement of two levers 25 and 26, which are connected to the rollers 10 to be adjusted, and by the position thereof on a guide 27, it is possible to set or adjust the distance between the respective rollers 10 individually. It is thereby possible to achieve a precise setting or adjustment. In this regard, the mounting supports at the ends of the spindles 9 may well be moved apart to different extents (note FIGS. 2 and 4).

In the operating phase illustrated in FIG. 5, the distance between the sides of the spindles 9 is represented by an unidentified double-headed arrow. This set position of a mounting support of the spindles 9 could be adjusted, for example, to tapering mounting-support positions of the former outlet rollers 10, as is illustrated in FIGS. 2 and 4. The levers 25 and 26 which, according to FIG. 5, are arranged in front or forward of the roller segments 10, are formed with recesses 28 by which they are accommodated together on the setting screw 27 like respective slotted guides.

The recesses 28 allow movement of the levers 25 and 26 relative to one another during the change in distance between the former outlet rollers 10.

The illustrated frame structure 8 has rolling elements 29, which may be carried by the frame 8 alternatively to the slide guides according to FIGS. 1 and 3. The rolling elements 29 run on profiled rails 11 which are supported on the frame structure 8 fastened to the former frame 4.

In addition to setting or adjusting, by manually operatable setting or adjusting elements 24.1 and 24.2, the positions of the spindles 9 whereon the outlet rollers 10 are mounted, the positions of the spindles 9 may also be actuated by setting or adjusting elements such as electric motors or the like. It would be possible, for example, initially to preselect a roller position as part of the order input at the rotation control console, without having to require the pressman or other press operator to reset the adjusting device 24. According to the invention, the positions of the frame 8 are changed, in any event, during a changeover from maximum to minimum web format or to a format somewhere in between and vice versa, by a displacement of the former-frame position.

The plan view of an embodiment of the frame 8 according to FIG. 6 illustrates the end-side mounting supports 7 of the frame 8. Located at the two ends of the spindles 9 is a respective adjusting device 24 having setting or adjusting elements 24.1 and 24.2. On the mutually adjustable spindles 9, the outlet rollers 10, interrupted by gaps, are mounted so as to be axially displaceable. The former outlet rollers 10 are formed with an approximately central annular recess 10.3 that subdivides the lateral surface of the former outlet rollers into a first roller section 10.1 and a second roller section 10.2. In the arrangement shown, the two spindles 9 for the former outlet rollers 10 are positioned parallel to one another. The annular recesses 10.3 formed in the former outlet rollers 10 are aligned with the axis 14 of the folder, and the frame 8 is aligned with the axis 18 of the first longitudinal folding device 1.

Those positions of the spindles 9 relative to one another which are shown in FIGS. 2 and 4 can be preadjusted or preset without difficulty via the adjusting devices 24 which are carried on the frame 8. It is possible to preset the angle a in a straightforward manner by the adjusting or setting elements 24.1 and 24.2, which can be displaced in the horizontal and vertical directions. The angle $\alpha$ also fixes the distance 21 between the outer surfaces of the material web 5 and the former outlet rollers 10. Of course, it is also possible for the outlet rollers 10 to be set so that the material web 5 and the surfaces of the rollers 10 are in contact with one another.

The former outlet rollers 10 move relative to the spindles 9 upon a displacement of the former frame 4, because the frame 8 that carries the former outlet rollers 10 is fastened to the former frame 4. It is believed to be readily apparent from the plan view according to FIG. 6 that the spindles 9 are connected to the respective setting or adjusting elements 24.1 and 24.2 via articulation heads in order to ensure the greatest possible freedom of movement of the spindles 9.

Guide rails 11, which may have a profiled construction, are visible beneath the frame 8. The rolling elements 29 run on the guide rails 11 so that the operation of displacing the frame 8 involves as little friction as possible. In addition to the guide rail 11 being profiled, it is also possible for the rails 11 to be prefabricated from round bars or other semifinished products.

As has been mentioned briefly hereinbefore, a first longitudinal folding device 1 may be located directly above the infeed into the cylinder part of a folder.

We claim:

1. A folder for web-fed printing machines for processing webs of material with longitudinal adhesive bonding, comprising:

a framework wall;

a frame carrying former outlet rollers and spindles whereon said former outlet rollers are mounted, said frame mounted on said framework wall as to be movable relative to said framework wall, and said former outlet rollers are mounted as to be movable relative to said spindles and to remain stationary relative to said framework wall.

2. The longitudinal folding device according to claim 1, wherein said spindles are movable axially relative to said former outlet rollers.

3. The longitudinal folding device according to claim 1, wherein said spindles are adjustable relative to one another on said frame.

4. The longitudinal folding device according to claim 3, including an adjusting device for adjusting said spindles of said former outlet rollers at a frame-side end thereof.

5. The longitudinal folding device according to claim 3, wherein said spindles of said former outlet rollers are adjustable in a horizontal plane on said frame.

6. The longitudinal folding device according to claim 3, wherein said spindles of said former outlet rollers are adjustable in a vertical plane on said frame.

7. The longitudinal folding device according to claim 1, wherein said former outlet rollers are formed approximately centrally with an annular recess.

8. The longitudinal folding device according to claim 1, wherein roller sections of said former outlet rollers have a coating formed thereon.

9. The longitudinal folding device according to claim 1, including crossmembers whereon said frame is displaceably mounted.

10. The longitudinal folding device according to claim 9, wherein said frame has slide guides through which said crossmembers extend.

11. The longitudinal folding device according to claim 1, wherein said frame has rolling elements supported on crossmembers.

12. A folder for web-fed printing machines for processing webs of material with longitudinal adhesive bonding, comprising:

a framework wall;

a frame carrying former outlet rollers and spindles whereon said former outlet rollers are mounted, said frame mounted on said framework wall as to be movable relative to said framework wall, and said former outlet rollers disposed, through the intermediary of a roller support, on framework walls of the folder.

13. The longitudinal folding device according to claim 12, wherein said spindles are adjustable relative to one another on said frame.

14. The longitudinal folding device according to claim 12, wherein said former outlet rollers are formed approximately centrally with an annular recess.

15. The longitudinal folding device according to claim 12, wherein roller sections of said former outlet rollers have a coating formed thereon.

16. In a folder for web-fed printing machines having a longitudinal folding device for processing webs of material with longitudinal adhesive bonding, the improvement comprising:

a framework wall;

a frame carrying former outlet rollers and spindles whereon the former outlet rollers are mounted, said frame mounted on said framework wall as to be movable relative to said framework wall, and said former outlet rollers mounted as to be movable relative to said spindles and to remain stationary relative to said framework wall.

* * * * *